US011428417B2

(12) United States Patent
Diehl et al.

(10) Patent No.: US 11,428,417 B2
(45) Date of Patent: Aug. 30, 2022

(54) HOME COOKING APPLIANCE HAVING A COOLING FAN AIR GUIDE

(71) Applicants: BSH Home Appliances Corporation, Irvine, CA (US); BSH Hausgeräte GmbH, Munich (DE)

(72) Inventors: Ronald Allen Diehl, LaFollette, TN (US); Josiah Fronckowiak, LaFollette, TN (US); Ian McIver, Knoxville, TN (US); Shaun Phillips, Jacksboro, TN (US)

(73) Assignees: BSH Home Appliance Corporation, Irvine, CA (US); BSH Hausgeräte GmbH, Munich (DE)

( * ) Notice: Subject to any disclaimer, the term of this patent is extended or adjusted under 35 U.S.C. 154(b) by 312 days.

(21) Appl. No.: 16/454,108

(22) Filed: Jun. 27, 2019

(65) Prior Publication Data

US 2020/0408419 A1 Dec. 31, 2020

(51) Int. Cl.

| | |
|---|---|
| ***F24C 15/00*** | (2006.01) |
| ***F24C 15/10*** | (2006.01) |
| ***F24C 3/08*** | (2006.01) |

(52) U.S. Cl.

CPC ..... *F24C 15/006* (2013.01); *F24C 3/082* (2013.01); *F24C 15/101* (2013.01)

(58) Field of Classification Search

CPC .... F24C 15/006; F24C 15/101; F24C 15/001; F24C 15/28; F24C 15/322; F24C 3/082; F24C 3/122

USPC ..... 126/39 R, 273 R, 42, 15 A, 21 A

See application file for complete search history.

(56) References Cited

U.S. PATENT DOCUMENTS

| | | | | | |
|---|---|---|---|---|---|
| 2,908,267 | A * | 10/1959 | Hess | F24C 3/027 | 126/299 R |
| 4,413,610 | A * | 11/1983 | Berlik | F24C 3/008 | 126/214 R |
| 4,736,729 | A * | 4/1988 | Beach | F24C 3/085 | 126/21 A |
| 5,474,055 | A * | 12/1995 | Kang | F24C 15/34 | 126/39 R |
| 6,234,161 | B1 * | 5/2001 | Levi | F24C 15/006 | 126/19 R |

(Continued)

FOREIGN PATENT DOCUMENTS

| | | | | |
|---|---|---|---|---|
| JP | 59044528 | A * | 3/1984 | F24C 15/04 |
| JP | 59044530 | A * | 3/1984 | F24C 15/006 |

(Continued)

*Primary Examiner* — Steven B McAllister
*Assistant Examiner* — Daniel E. Namay
(74) *Attorney, Agent, or Firm* — Michael E. Tschupp; Andre Pallapies; Brandon G. Braun

(57) ABSTRACT

A home cooking appliance includes a housing, a cooktop on the housing, the cooktop having at least one gas burner, a cooking compartment in the housing and accessible through a door in a front of the housing, a cooling air system having a cooling fan that conveys cooling air through the housing, and an air guide between the cooktop and the cooking compartment, the air guide including an inlet located away from a space below the at least one gas burner of the cooktop and an outlet in fluid communication with the cooling fan, the air guide configured to restrict air from being drawn into the cooling fan from the space below the at least one gas burner of the cooktop.

20 Claims, 12 Drawing Sheets

(56) References Cited

U.S. PATENT DOCUMENTS

| | | | | |
|---|---|---|---|---|
| 7,923,663 | B2 | 4/2011 | Kim et al. | |
| 8,402,962 | B2 * | 3/2013 | Kim | F23D 14/04 126/39 E |
| 10,288,298 | B2 * | 5/2019 | Chadwick | F24C 15/2007 |
| 10,317,091 | B2 * | 6/2019 | Chadwick | F24C 15/006 |
| 10,495,318 | B2 * | 12/2019 | Greenbaum | F24C 15/006 |
| 2004/0060552 | A1 * | 4/2004 | Yamada | F24C 3/067 126/39 K |
| 2006/0150965 | A1 * | 7/2006 | Kim | F24C 15/2042 126/299 D |
| 2006/0254574 | A1 * | 11/2006 | Lee | F24C 3/067 126/39 R |
| 2014/0150771 | A1 | 6/2014 | Gayle et al. | |
| 2015/0075513 | A1 * | 3/2015 | Paller | F24C 15/006 126/198 |
| 2015/0260413 | A1 * | 9/2015 | Chadwick | F24C 15/006 126/21 R |
| 2015/0260416 | A1 * | 9/2015 | Chadwick | F24C 15/2042 454/56 |
| 2018/0003389 | A1 * | 1/2018 | Trice | F24C 3/027 |
| 2019/0212014 | A1 * | 7/2019 | Chadwick | F24C 15/02 |
| 2020/0191406 | A1 * | 6/2020 | Yun | F24C 15/101 |
| 2020/0408412 | A1 * | 12/2020 | Hanna | F24C 15/006 |

FOREIGN PATENT DOCUMENTS

| | | | |
|---|---|---|---|
| KR | 20020039905 | A | 5/2002 |
| KR | 20100049787 | A | 5/2010 |
| WO | 2014016033 | A1 | 1/2014 |

* cited by examiner

HOME COOKING APPLIANCE HAVING A COOLING FAN AIR GUIDE

FIELD OF THE INVENTION

The present invention is directed to a home cooking appliance having an air guide, and more particularly, to a home cooking appliance having a cooling fan and an air guide capable of restricting air from a space between a cooktop and the chassis floor from being drawn into the cooling fan.

BACKGROUND OF THE INVENTION

A conventional home cooking appliance, such as a slide-in gas range, may include a housing having a cooking compartment, such as a baking oven, convection oven, steam oven, warming drawer, etc., and a cooking surface formed, for example, by cooking grates disposed over gas burners on the top of the housing. Such a conventional slide-in range may be installed in a cooking area of a home kitchen between countertops and floor cabinets with a rear wall of the appliance facing a back wall of the kitchen. Industry standards and regulations commonly dictate acceptable temperatures of the combustible back wall behind the appliance, acceptable temperatures of cabinets or components over the range or adjacent to the range, as well as acceptable door temperatures for the appliance during operation. As a result, many conventional appliances include a cooling air system to maintain acceptable surface temperatures and oven door temperatures, to protect components in and around the appliance, etc.

SUMMARY OF THE INVENTION

The present invention recognizes that a home cooking appliance, such as a slide-in gas range, may include a cooktop having one or more gas burners or the like configured as bottom-breathing gas burners. In operation, such bottom-breathing gas burners may draw air (e.g., primary air) from a space between a cooktop surface supporting the gas burner (i.e., cooktop floor) and a chassis floor of the cooktop and mix the primary air with fuel (e.g., natural gas) to supply an air-gas mixture to a burner head of the gas burner. During operation of one or more cooking components of the home cooking appliance, one or more cooling fans or blowers of a cooling air system of the home cooking appliance may draw cooler air into the housing of the appliance from areas outside of the appliance and convey this lower temperature air (i.e., cooling air) through, for example, the space between a top insulation retainer of a cooking compartment (such as a baking oven, convection oven, steam oven, warming drawer, etc.) of the appliance and a chassis floor of the cooktop. In this way, a quantity of heat from components of the appliance, such as components of the cooking compartment, can be transferred to the cooling air, which can then be exhausted from the appliance by the cooling fan.

The present invention recognizes that, in some instances, for example when a cooling fan is operating at a maximum rate, the fan may draw a large enough volume of air through the range that air from the space between the cooktop and the chassis floor, which is used as primary air by the bottom-breathing gas burners for mixing with fuel, can be undesirably drawn through holes, gaps, etc. in the chassis floor toward the fan/blower, which may decrease the performance of the bottom-breathing gas burners. For example, the fan may draw a large enough volume of air from the space between the cooktop and the chassis floor such that insufficient air is available for use as primary air by the bottom-breathing gas burners for mixing with fuel or such that a flow of the air and/or fuel into a venturi of one or more burners is disrupted, among other things, which may decrease the performance of one or more of the cooktop burners, affect the stability of flame kernels of one or more burners, etc.

To solve these and other problems, the present invention provides a home cooking appliance comprising a housing, a cooktop on the housing, the cooktop having at least one gas burner, a cooking compartment in the housing and accessible through a door in a front of the housing, a cooling air system having a cooling fan that conveys cooling air through the housing, and an air guide between the cooktop and the cooking compartment, the air guide including an inlet located away from a space below the at least one gas burner of the cooktop and an outlet in fluid communication with the cooling fan, the air guide configured to restrict air from being drawn into the cooling fan from the space below the at least one gas burner of the cooktop. In this way, the present invention provides a home cooking appliance having an air guide capable of restricting (e.g., preventing or minimizing) air from the space between the cooktop and the chassis floor from being drawn into the fan, thereby avoiding disruption of air in the space between the cooktop and the chassis floor that is available for use as primary air by the burners, stabilizing burner flames, and increasing overall burner performance.

An exemplary embodiment of the invention provides an air guide that forms a designated air duct in a simple manner that is capable of controlling, or at least constraining or limiting, a flow of air being drawn toward or into the cooling fan such that the cooling fan can only draw air through areas of the appliance housing at, near, or adjacent to a front frame of the housing and not through the chassis floor from the space between the cooktop and the chassis floor. The exemplary embodiments can control the flow of air though the appliance in order to increase the cooktop burner performance By isolating the air which the fan draws through the appliance, the air which the burners need to function properly can be left undisturbed. The exemplary embodiments of an air guide can provide these benefits without affecting thermal test results which are important (e.g., critical) to the safety of an appliance, such as an oven range. The minimalistic air guide according to the exemplary embodiments can be compatible and effective across various models and configurations of appliances, such as stand-alone ranges, thereby providing a functional, versatile, and efficient solution for controlling, or at least constraining or limiting, a flow of air being drawn toward or into one or more cooling fans from the space between the cooktop and the chassis floor, thereby increasing the performance and efficiency of gas cooktop burners on the appliance.

In some examples, an air guide can form a designated air duct that is capable of restricting or limiting the amount of air being drawn toward or into a cooling fan from the space between the cooktop and the chassis floor. For example, the air guide can form a designated air duct that restricts the amount of air from the space between the cooktop and the chassis floor that can be drawn toward or into a cooling fan, for example, with the exception of minor leaks of air around or between connections of the air guide to other components. In other examples, an air guide can form a sealed air flow duct that is capable of isolating (e.g., completely isolating) a flow of air being drawn toward or into a cooling fan from the air in the space between the cooktop and the chassis floor. For example, the air guide can form a sealed air duct configured to prevent any air from the space between the cooktop and the chassis floor from being drawn into the cooling fan.

The exemplary embodiments of the air guide can be configured in a simple manner that minimizes complexity of parts. The air guide can be configured such that a part or element of the air guide forms a designated air duct between at least a portion of the chassis floor and a top of the cooking compartment, and more particularly, between at least a portion of the chassis floor and a top insulation retainer above a cooking compartment. The air guide can be configured to separately form an air duct or to cooperate with one or more other components, such as a portion of the top insulation retainer, to form an air duct.

In an exemplary embodiment, the air guide can include a top wall and two sidewalls that cooperate with the top insulation retainer to form an air duct. In an example, the air guide can include one or more portions, such as one or more flanges, configured to couple the air guide to a component of the appliance, such as the top insulation retainer. Each flange can be coupled to the top insulation retainer, for example, by one or more fasteners, such as one or more rivets. In these ways, the exemplary embodiments can minimize noise transmission from the cooling fan to the air guide or from the air flow through the duct to other components of the appliance, while also creating as close to a sealed air flow duct as possible between the air guide and the top insulation retainer.

In some examples, the air guide can be configured such that a predetermined clearance is provided between a top surface of the air guide and an underside of the chassis floor, which may minimize noise transmission from the air guide to the chassis floor or other components of the appliance.

In some examples, the air guide can be configured such that a part or element of the air guide (e.g., a downstream end of the air guide adjacent to the cooling fan) is essentially hung off of a part of the cooling fan, such as a structural component or part of a housing of the cooling fan, and fit (e.g., snugly fit) between the chassis floor and a top insulation retainer. In an example, the air guide can include a flange on an upper part that is configured to provide a secure press fit against a part of the cooling fan, such as a structural component or part of a housing of the cooling fan. In an example embodiment, the cooling fan can include a separate or integrally formed component configured to receive the flange of the air guide such that the flange can be simply and easily secured (e.g., in a press fit manner) on the component of the cooling fan. For example, the cooling fan can include a lip, flange, tab, or the like, on a structural cross member of the fan or the housing of the fan configured to receive an end of the flange of the air guide to secure (e.g., in a press fit manner) the air guide to the cooling fan. In this way, the air guide can be coupled or secured to the cooling fan (e.g., a top flange of the air guide can be coupled to a lip on a structural cross member of the cooling fan), thereby minimizing noise or vibration, while also creating as close to a sealed air flow duct as possible between the air guide and the cooling fan.

In some examples, the air guide can be configured such that a part or element of the air guide (e.g., a downstream end of the air guide adjacent to the cooling fan) extends from the air guide such that the air can flow unrestricted into the intake of the cooling fan. The downstream part or element of the air guide can be formed by one or more angled plates or flanges (or curved plates, flanges, or the like) and can include a flange configured to provide a secure press fit against a part of the cooling fan. The downstream part or element of the air guide can be configured to further constrain or minimize air from the space between the cooktop and the chassis floor from being drawn into the fan through other components of the appliance, such as through openings, gaps, etc. formed in a sidewall of the cooktop chassis or other structural or sheet metal components between the cooling fan and the space below the cooktop. In some examples, the air guide can be configured such that a predetermined clearance is provided between the downstream part or element of the air guide and a sidewall of the cooktop chassis or other structural or sheet metal components, which may minimize noise transmission to the cooktop chassis or other components of the appliance. In some examples, the downstream part or element of the air guide can include one or more cutouts, tapered or angled portions, etc. to facilitate installation and provide clearance between the air guide and the sidewall of the cooktop chassis, other structural or sheet metal components of the appliance, or functional components of the appliance (e.g., gas supply lines, electrical components, etc.).

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 1:
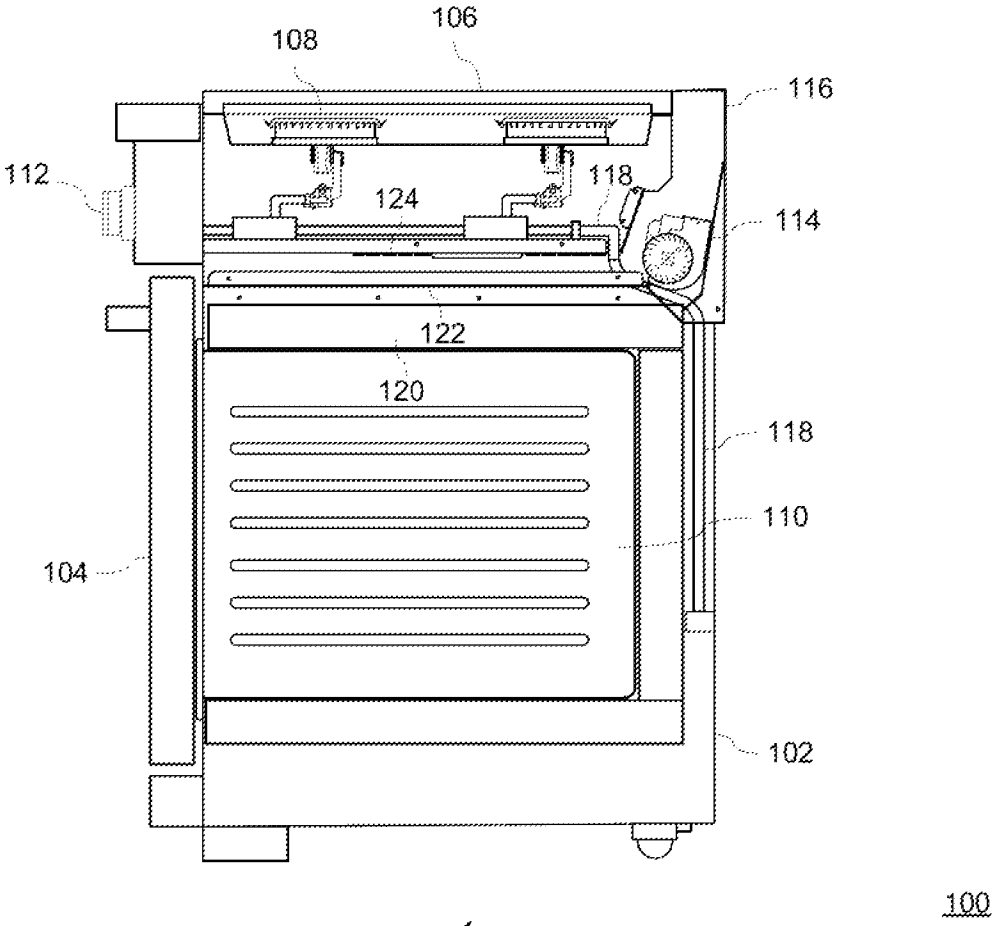
FIG. 1 (CONVENTIONAL ART)
FIG. 1 is a schematic side, cutaway view of a household cooking appliance.
Figure 2:
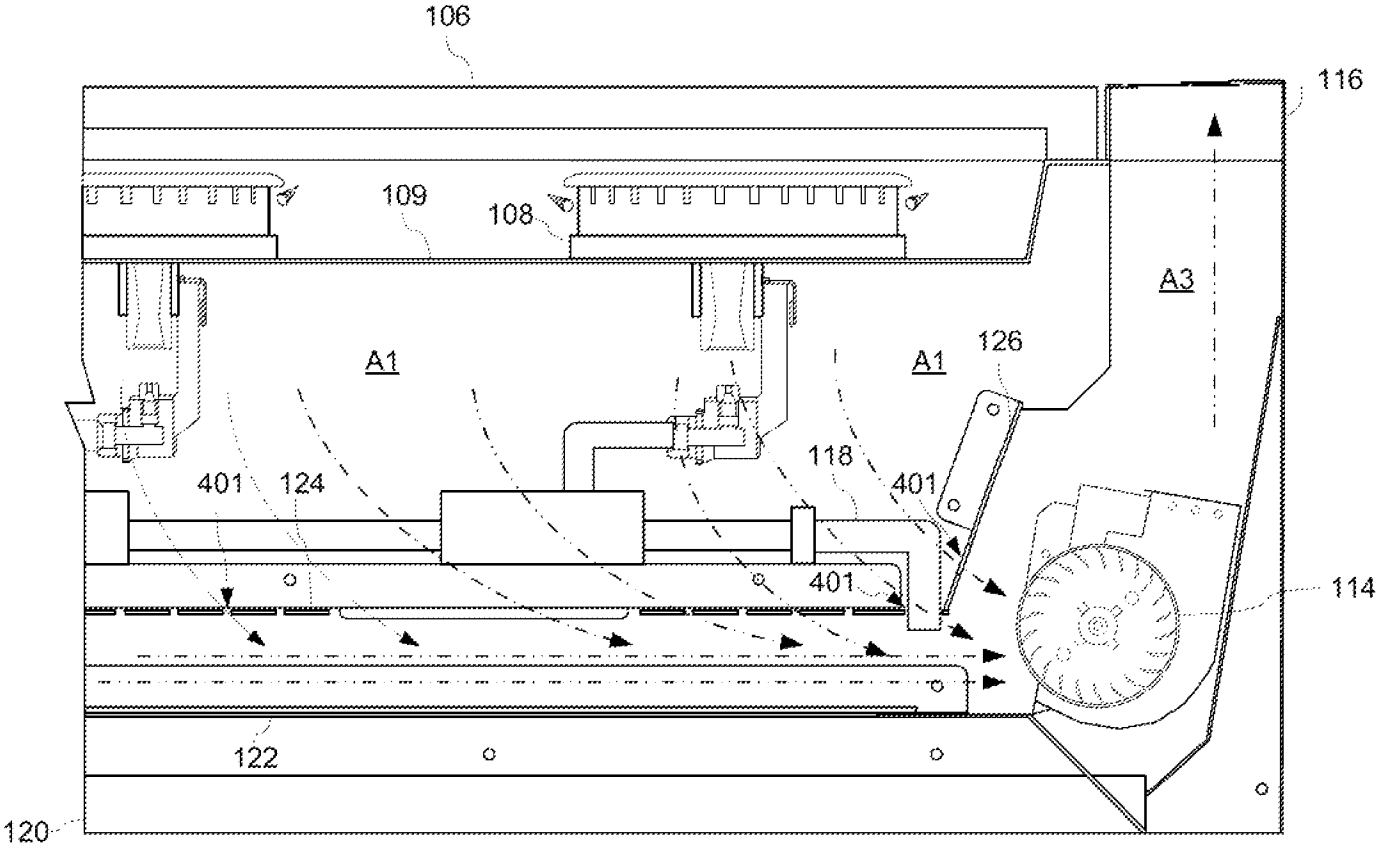
FIG. 2 (CONVENTIONAL ART)
FIG. 2 is a schematic partial view of the household cooking appliance of FIG. 1.

With reference to FIGS. 1 and 2, a household cooking appliance 100, such as a slide-in gas range, may have a housing 102 with one or more cooking compartments 110, such as one or more baking ovens, convection ovens, steam ovens, warming drawers, etc., in the housing 102 and accessible through one or more corresponding doors 104 in a front of the housing 102. One of ordinary skill will recognize that an appliance can have various configurations of one or more cooking compartments 110. The home cooking appliance 100 can include a cooking surface on a top of the housing 102, such as one or more cooking grates, griddles, grills, teppanyaki grills, etc. 106, having an upper surface for supporting cookware over one or more gas burners 108. One or more gas burners 108 can be disposed on or supported by a cooktop floor or spill tray 109. The gas burners 108 can be supplied gas via one or more gas supply lines 118 disposed under a portion of the cooktop floor 109. The appliance 100 can include a control panel having a plurality of control knobs 112 for controlling the respective operation of the gas burners 108 and the cooking compartments 110, such as controlling a flow of gas from a gas supply line 118 to a gas burner 108. The housing 102 can include a rear vent trim 116 on the top of the housing 102 at a rear side of the cooking surface 106. The rear vent trim 116 can include one or more openings arranged in fluid communication with one or more cavities or ducts for exhausting cooling air circulated or passed through the appliance (e.g., through the housing 102 and/or door 104 of the appliance 100). The rear vent trim 116 also may exhaust flue gases from one or more cooking compartments 110 from one or more additional openings.

As shown in FIGS. 1 and 2, the appliance 100 can include one or more insulation elements 120 surrounding all or a portion of a cooking compartment 110. An insulation retainer (e.g., top insulation retainer 122) may be provided to secure one or more of the insulation elements 120 around the exterior of a cooking compartment 110.

One or more of the gas burners 108 can be configured as a bottom-breathing gas burner. In operation, a bottom-breathing gas burner 108 may draw air (e.g., primary air A1) from a space below the cooktop floor 109 and between the cooktop floor 109 supporting the gas burner 108 and a chassis floor 124 of the cooktop. The bottom-breathing gas burner 108 can mix the primary air A1 with fuel (e.g., gas) to supply an air-gas mixture to a burner head of a gas burner 108.

The home cooking appliance 100 can include a cooling air system having one or more cooling fans or blowers 114 configured to draw cooler air into the appliance 100 from areas outside of the appliance 100 such as from openings in or around the door 104, openings in or around a front frame or other part of the housing 102, etc. The cooling fan 114 of the cooling air system can convey this lower temperature air (i.e., cooling air) through various interior areas of the door 104 and/or the housing 102, and then exhaust the air from the housing 102 from one or more locations, such as from the rear vent trim 116, in order to maintain acceptable surface temperatures and oven door temperatures, to protect components in and around the appliance, etc. For example, a cooling fan 114 can be disposed toward a rear of the housing 102 and above a cooking compartment 110. The cooling fan 114 can be configured to draw cooler air into the appliance 100 from areas outside of the appliance 100 and convey the cooler air through the space between the cooking compartment 110 and the cooktop floor 109. In this way, a quantity of heat from components of the appliance, such as heat from the operation of the cooking compartment 110, can be transferred to the cooler air being drawn through the appliance 100 by the cooling fan 114. The cooling fan 114 then can exhaust the now heated air (e.g., A3) from one or more openings in the rear vent trim 116. In some examples, the appliance 100 can include a plurality of cooking compartments 110 and one or more cooling fans 114 can be provided for the cooking compartments 110, such as a corresponding cooling fan 114 for each cooking compartment 110. One of ordinary skill will recognize that a cooling fan 114 can circulate cooling air of a cooling air system for cooling components of one or more cooking compartments 110.

The present invention recognizes that, when a cooling fan 114 is operating, for example at a maximum flow rate, the cooling fan 114 may be capable of drawing a larger volume of air through the housing 102 than can be conveyed to the cooling fan 114 through, for example, a space between the top insulation retainer 122 and the chassis floor 124 of the cooktop. In some circumstances, the cooling fan 114 may additionally draw air A1 from the space between the cooktop floor 109 and the chassis floor 124 through one or more openings, perforations, cut-outs, knock-outs, etc. 401 in the chassis floor 124, chassis sidewall 126, or another component, and/or through gaps between parts of the chassis floor 124, chassis sidewall 126, or other components, as schematically illustrated in FIG. 2. As a result, insufficient air A1 may be available for use as primary air by one or more of the gas burners for mixing with fuel, which may decrease the performance of one or more of the gas burners (e.g., starve the gas burner of primary air), affect the stability of flame kernels (e.g., color, shape, heat output, etc.) of one or more burners, etc. Additionally or alternatively, a flow of the air A1 and/or fuel into a venturi of one or more of the gas burners (e.g., the vacuum or suction effect on the air A1 resulting from injecting fuel from a gas burner jet into a venturi) may be affected or disrupted, which also may decrease the performance of one or more of the gas burners, affect the stability of flame kernels of one or more burners, etc.

For example, as shown in FIG. 2, the chassis floor 124, chassis sidewall 126, and/or other components may include one or more openings 401, for example, for accommodating one or more gas lines 118 or other elements, such as components or wires related to igniters, electronics, etc. These openings 401 may permit some of the air A1 to be drawn through the chassis floor 124, chassis sidewall 126, and/or other components toward or into the cooling fan 114, as schematically illustrated by the dashed air-flow lines in FIG. 2. The chassis floor 124, chassis sidewall 126, and/or another component may be penetrated by one or more fasteners, such as screws, for mounting or securing other components, which also may permit a quantity of air A1 to be drawn through the chassis floor 124, chassis sidewall 126, and/or other components toward or into the cooling fan 114. The chassis floor 124, chassis sidewall 126, and/or other components may include various other un-occupied openings, penetrations, knock-outs, etc. (e.g., 401) for use with alternate models and configurations of the appliance, which also may permit a quantity of air A1 to be drawn through the chassis floor 124, chassis sidewall 126, and/or other components toward or into the cooling fan 114. Other components, such as additional retainers, mounting surfaces, brackets, sheet metal components, etc. may include openings, etc. (e.g., 401) formed therein or gaps therebetween that also may permit air A1 to be drawn toward or into the cooling fan 114 from the space between the cooktop floor 109 and the chassis floor 124 of the cooktop.

With reference to FIGS. 3-9, exemplary embodiments of a home cooking appliance 100 including an air guide 300 configured to restrict air from being drawn into the cooling fan 114 from a space below one or more gas burners of the cooktop will now be described.

Figure 3:
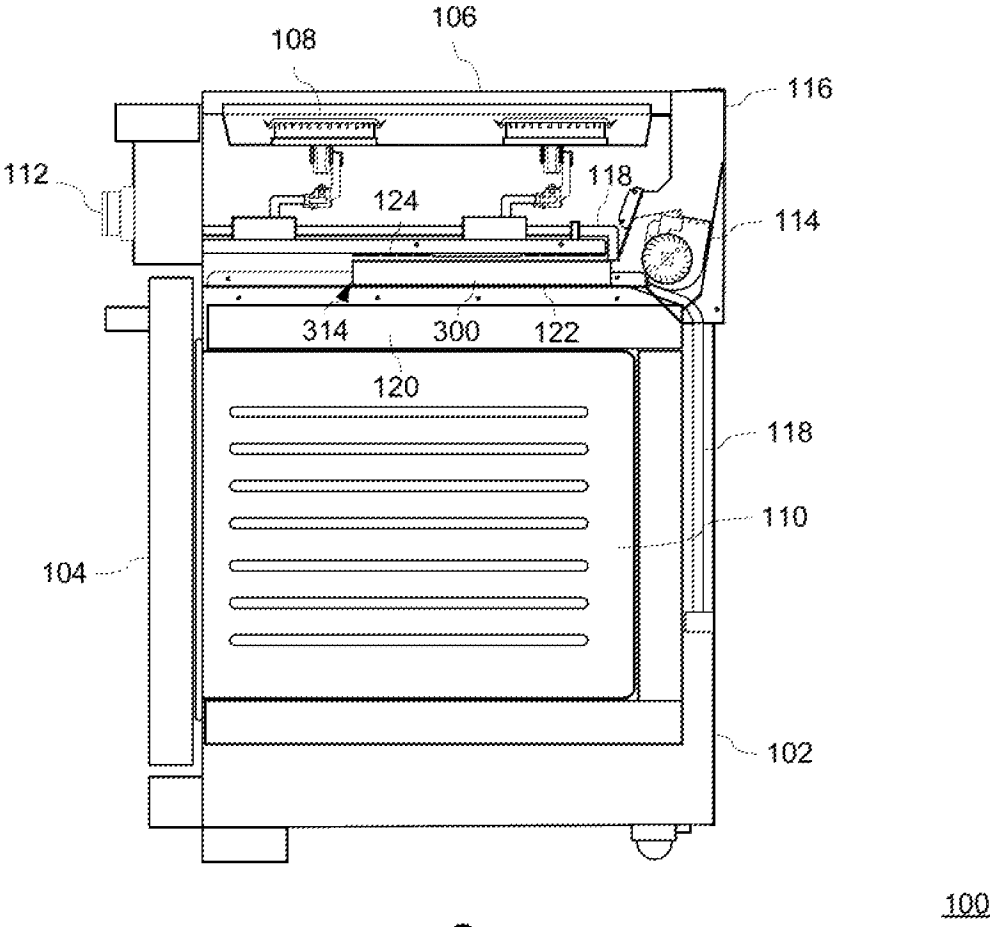
FIG. 3 is a schematic side, cutaway view of a household cooking appliance according to an exemplary embodiment of the invention.
Figure 4:
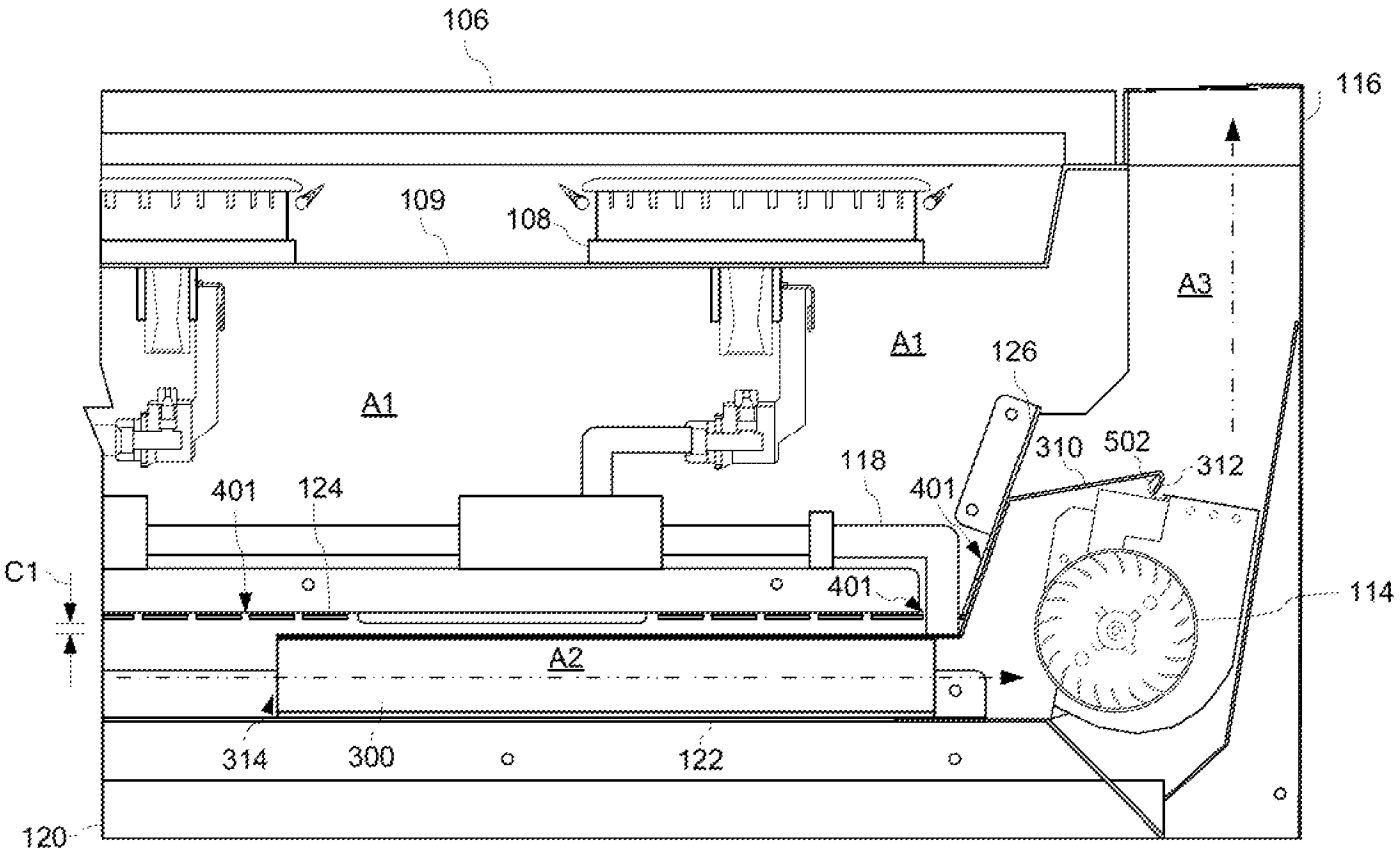
FIG. 4 is a schematic partial view of the household cooking appliance of FIG. 3.
Figure 5A:
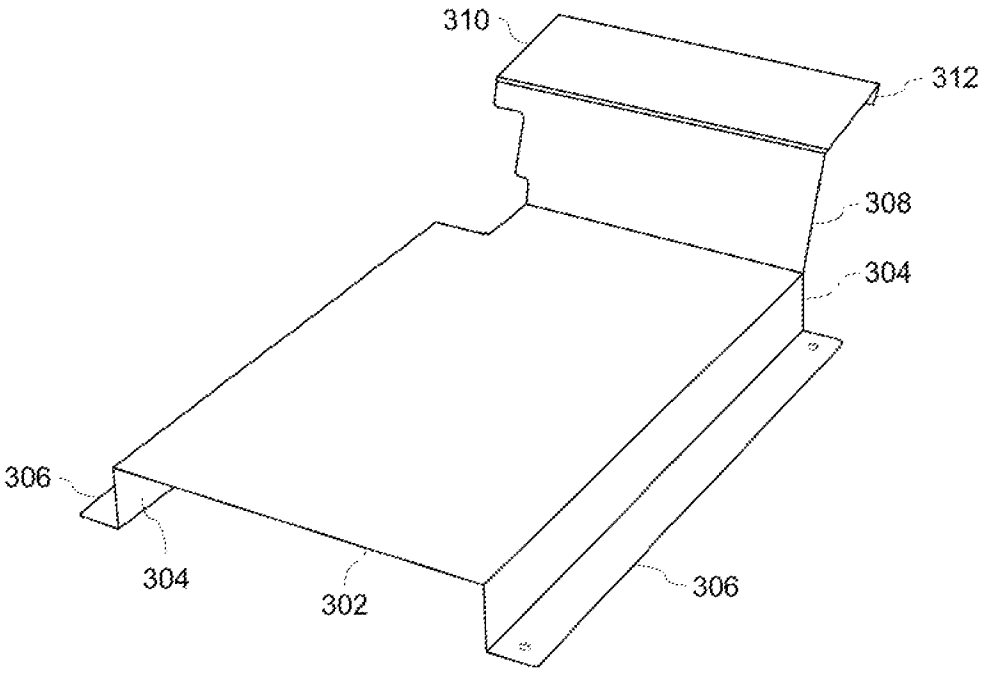
FIG. 5A is a perspective view of an air guide according to an exemplary embodiment of the invention.
Figure 5C:
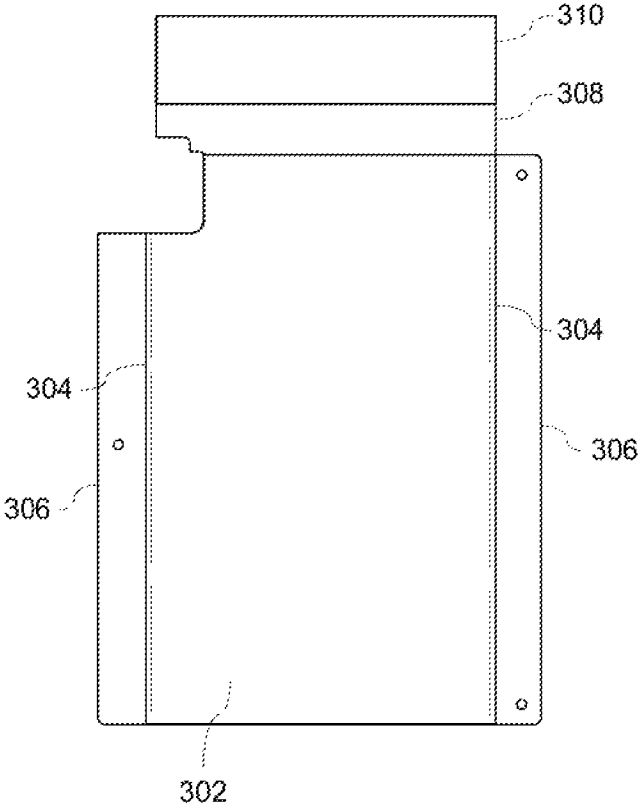
FIG. 5C is a top view of an air guide according to an exemplary embodiment of the invention.
Figure 5B:
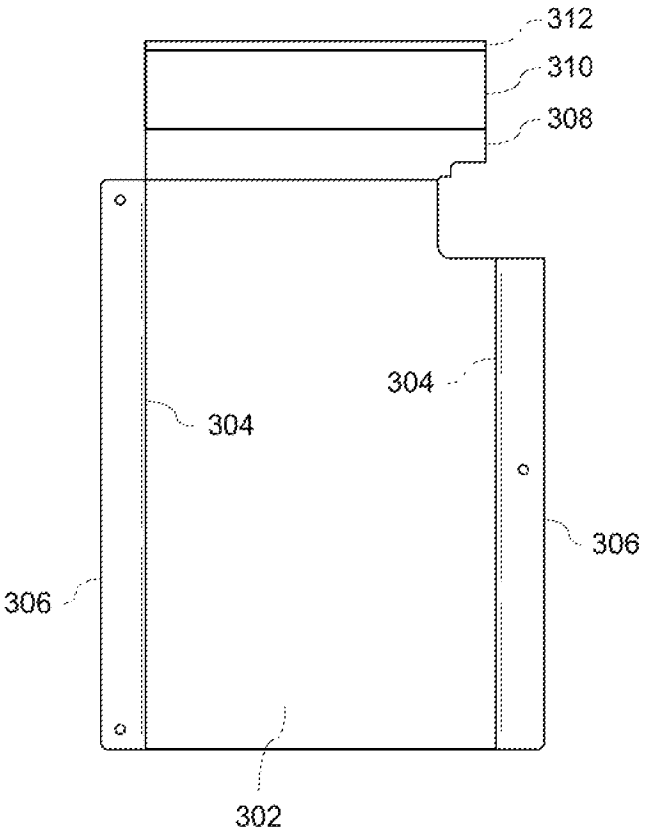
FIG. 5B is a bottom view of an air guide according to an exemplary embodiment of the invention.
Figure 5D:
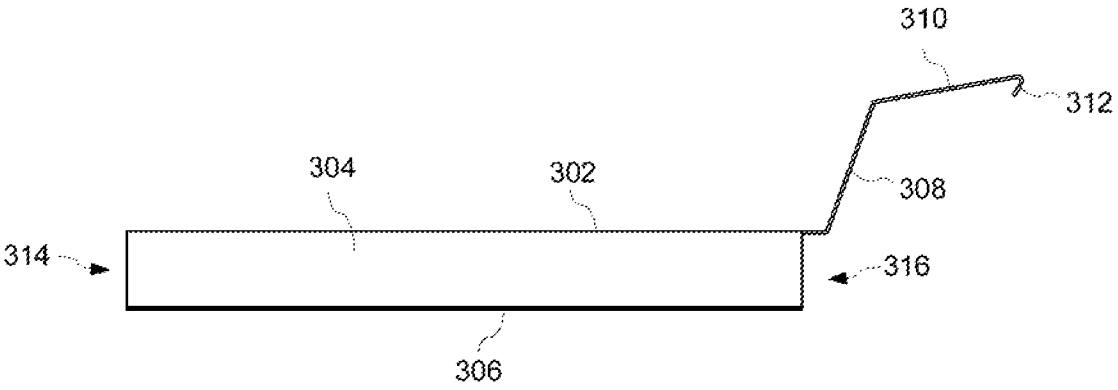
FIG. 5D is a first side view of an air guide according to an exemplary embodiment of the invention.
Figure 5E:
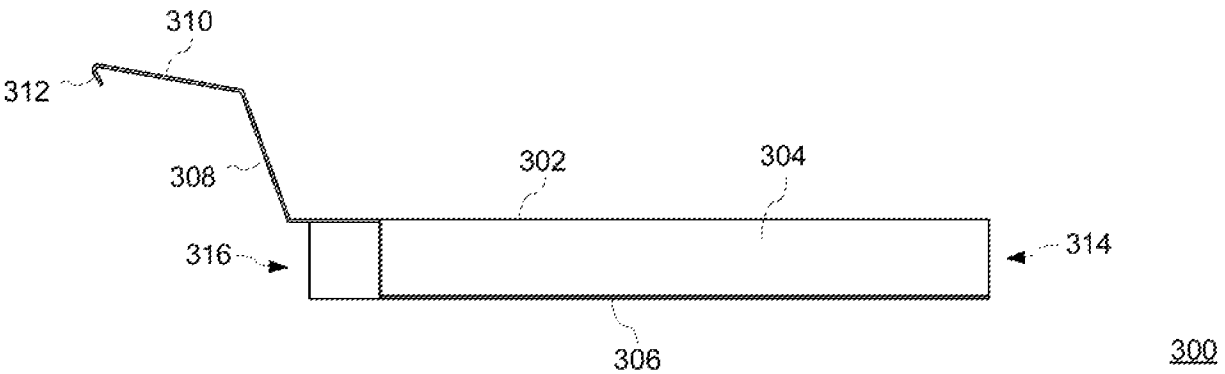
FIG. 5E is a second side view of an air guide according to an exemplary embodiment of the invention.
Figure 5F:
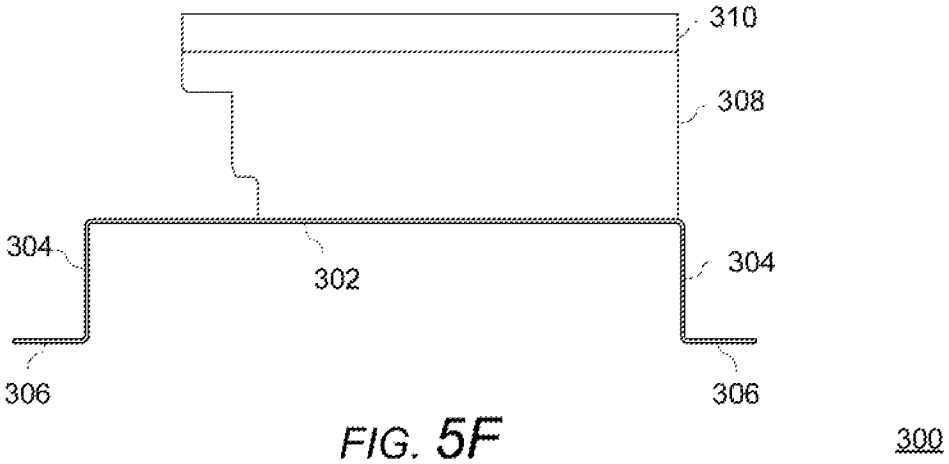
FIG. 5F is a front view of an air guide according to an exemplary embodiment of the invention.
Figure 5G:
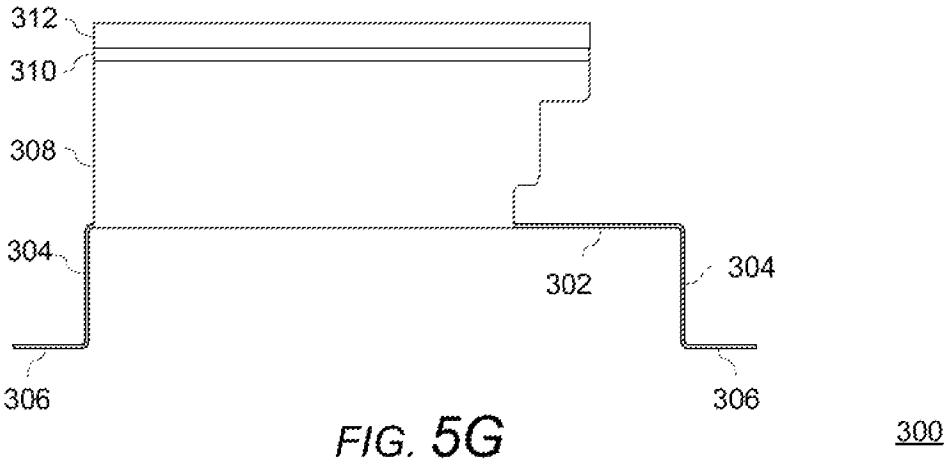
FIG. 5G is a rear view of an air guide according to an exemplary embodiment of the invention.

With reference to FIGS. 3 and 4, an exemplary home cooking appliance 100 includes an air guide 300 in fluid communication with the cooling fan 114 of the cooling air system. The air guide 300 can be configured to restrict an amount of air A1 that can be drawn (or prevent any air A1 from being drawn altogether) toward or into the cooling fan 114 from the space between the cooktop floor 109 and the chassis floor 124, thereby avoiding disruption of the available primary air A1 in the space between the cooktop floor 109 and the chassis floor 124, stabilizing burner flames, and increasing overall burner performance. The air guide 300 can be configured to form a designated air duct in a simple manner that is capable of controlling, or at least constraining or limiting, a flow of air A2 being drawn toward the cooling fan 114 such that the cooling fan 114 only draws air A2 from areas of the housing 102 at, near, or adjacent to the front frame of the housing 102 and door 104 of the housing, and not through the chassis floor 124 from the space between the cooktop floor 109 and the chassis floor 124.

As shown in FIGS. 3 and 4, the air guide 300 can be disposed between the chassis floor 124 and a cooking compartment 110, and more particularly, between the chassis floor 124 and a top insulation retainer 122 of a cooking compartment 110. In an example, the air guide 300 can include at least one wall cooperating with the top insulation retainer 122 to restrict an amount of air A1 that can be drawn (or prevent any air A1 from being drawn altogether) through the various openings, perforations, cut-outs, knock-outs, gaps, etc. 401 in the chassis floor 124, chassis sidewall 126, or other components toward or into the cooling fan 114. The at least one wall of the air guide 300 also can cooperate with the top insulation retainer 122 to form a flow path for guiding air (e.g., A2) from a particular location or region at the front of the housing 102 to the cooling fan 114.

As explained, the appliance 100 can include a plurality of cooking compartments 110 and one or more cooling fans 114 can be provided for the cooking compartments 110. A single cooling fan 114 can circulate cooling air of a cooling air system for one or more cooking compartments 110. In other examples, the appliance 100 can include a plurality of cooling fans 114. For example, a cooling fan 114 can be provided for each of a plurality of cooking compartments 110. According to the exemplary embodiments of the invention, the appliance 100 can include a plurality of air guides 300, such as a corresponding air guide 300 for each cooling fan 114.

Referring to FIGS. 5A-5G, an exemplary embodiment of an air guide 300 will now be described. The air guide 300 can be formed by one or more walls 302, 304 configured to cooperate with the top insulation retainer 122 or another surface/component of the appliance to form a flow path between an inlet 314 and an outlet 316. For example, the air guide 300 can include an upper wall 302 and a pair of sidewalls 304 extending from the upper wall 302 of the air guide 300 to, for example, the top insulation retainer 122 of the appliance 100 or another surface/component, thereby defining an air flow path for conveying air A2 between the inlet 314 and the outlet 316. The air guide 300 can include one or more connections, such as flanges 306 or other suitable connection means, for coupling the air guide 300 to, for example, the top insulation retainer 122 of the appliance 100 or another component.

Figure 6:
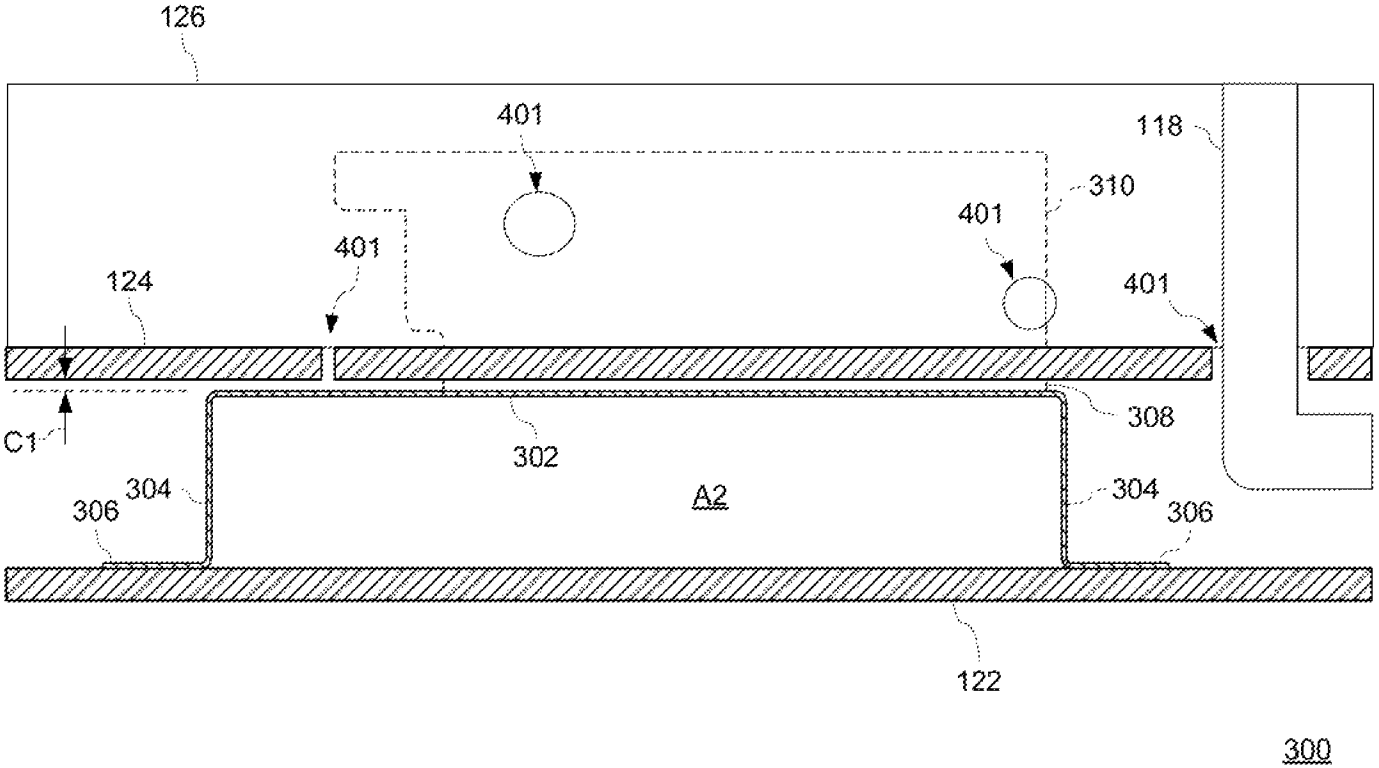
FIG. 6 is a schematic, partial cross-sectional view of a household cooking appliance having an air guide according to an exemplary embodiment of the invention.

As shown in the example assemblies illustrated in FIGS. 4 and 6, the ends of the pair of sidewalls 304 and/or the flanges 306 can physically contact or abut the surface of the top insulation retainer 122 to form a substantially sealed flow path for the air A2 between the inlet 314 and the outlet 316 of the air guide 300. In some examples, each flange 306 can be coupled to the top insulation retainer 122, for example, by one or more fasteners, such as one or more rivets.

Figure 7:
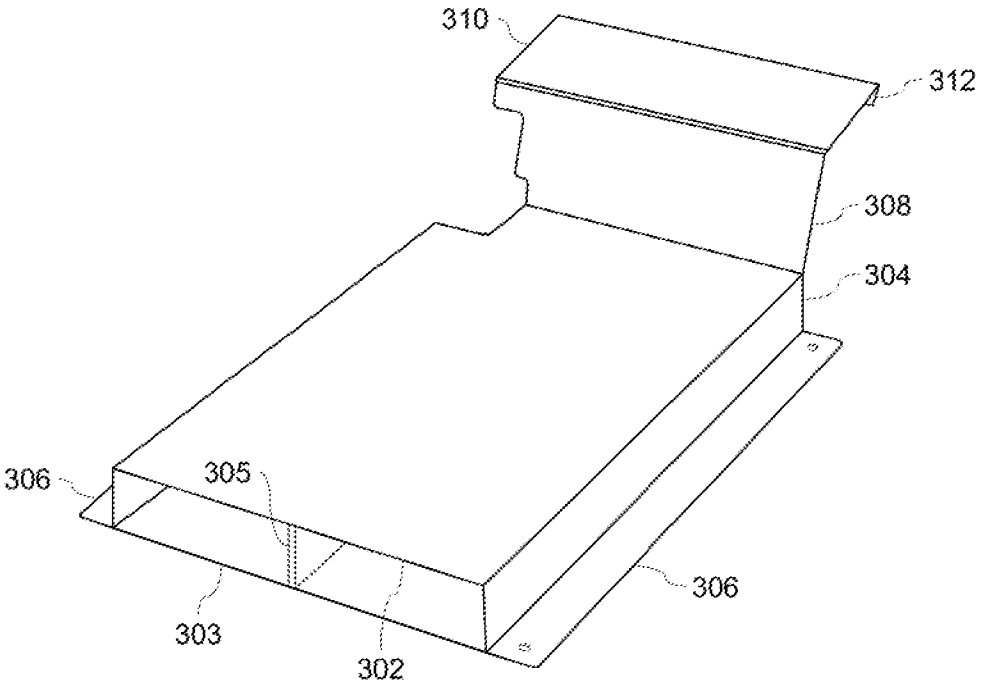
FIG. 7 is a perspective view of an air guide according to another exemplary embodiment of the invention.
Figure 8:
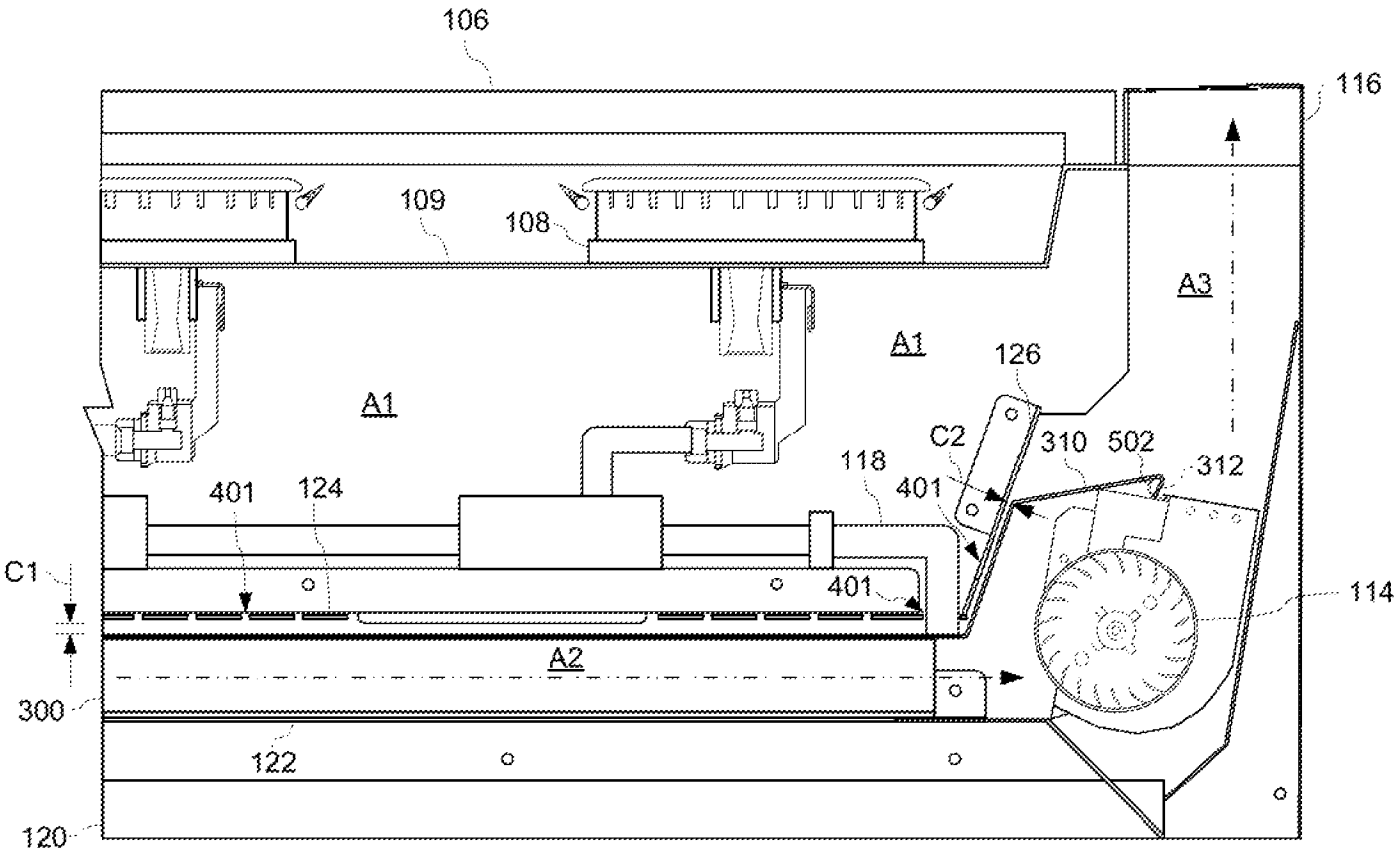
FIG. 8 is a schematic partial view of a household cooking appliance having an air guide according to another exemplary embodiment of the invention.
Figure 9:
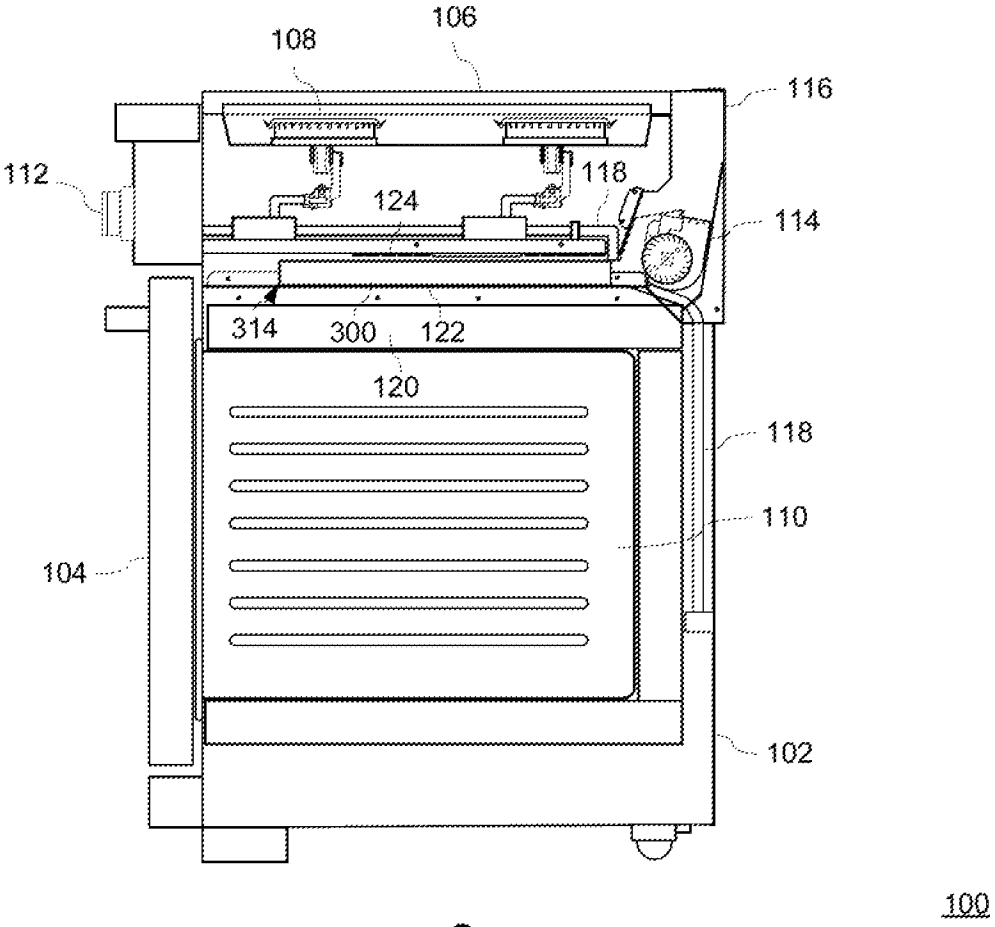
FIG. 9 is a schematic side, cutaway view of a household cooking appliance according to another exemplary embodiment of the invention.

In another exemplary embodiment, as illustrated in FIG. 7, the air guide 300 can be formed by a stand-alone component, such as a sealed duct or channel. The air guide 300 can include, for example, an upper wall 302, a lower wall 303, and a pair of sidewalls 304 extending from the upper wall 302 to the lower wall 303, thereby defining a completely sealed air flow path for conveying air A2 between the inlet 314 and the outlet 316. One of ordinary skill in the art will recognize that the arrangement of the air guide 300 is not limited to the illustrated examples, and other arrangements are contemplated by the present invention, such as the air guides having different cross-sectional shapes, air guides cooperating with other components or surfaces, etc. In other examples, the air guide 300 can include a plurality of flow paths for conveying the air A2. For example, the air guide 300 can include one or more dividers 305, as exemplarily illustrated by the dashed lines in FIG. 7.

With reference again to FIGS. 5A-5G, the air guide 300 can include one or more elements or portions (e.g., one or more plates, flanges, etc.) extending from the upper wall 302 at a top of the outlet 316 that are configured to guide the air A2 exiting the outlet 316 of the air guide 300 to an intake of the cooling fan 114 and/or secure the air guide 300 to a portion of the cooling fan 114. In this example, the air guide 300 can include a first angled plate portion 308 configured to extend upward from the upper wall 302 toward an upper end of the cooling fan 114. The air guide 300 can include a second angled plate portion 310 extending from the first angled plate portion 308 over a portion of the upper end of the cooling fan 114. One of ordinary skill in the art will recognize that the portions (e.g., 308, 310) extending from the upper wall 302 are not limited to any particular quantity or to any particular shape and can include one or more angled and/or curved portions. In some examples, one or more of the portions (e.g., 308, 310) of the air guide can include one or more cutouts, tapered or angled portions, etc. to facilitate installation and provide clearances between the air guide and other components, such as the sidewall of the cooktop chassis, other structural or sheet metal components of the appliance, or functional components of the appliance (e.g., gas supply lines, electrical components, etc.).

As shown in the assembled embodiments illustrated in FIGS. 4 and 6, the first and second plate portions 308, 310 can be configured to restrict an amount of air A1 that can be drawn, or prevent any air A1 from being drawn altogether, through openings, etc. 401 in the chassis sidewall 126 or other components toward or into the cooling fan 114, thereby further avoiding disruption of the available primary air A1 in the space defined by the cooktop floor 109, the chassis floor 124, and the chassis sidewall(s) 126.

Referring again to FIGS. 5A-5G, the air guide 300 can include a flange 312, for example, at an end of the second plate portion 310. The flange 312 can be configured to couple or secure the air guide 300 to the cooling fan 114. As shown in the assembled embodiment illustrated FIG. 4, the cooling fan 114 can include a corresponding lip, flange, tab, or the like (e.g., 502) integrally formed with or coupled to a structural cross member of the housing of the cooling fan 114. The lip, flange, tab, etc. 502 can be configured to receive the flange 312 of the air guide 300 to secure (e.g., in a press fit manner) the air guide 300 to the cooling fan 114. The press-fit connection can minimize noise or vibration between the air guide 300 and cooling fan 114. The press-fit connection also can seal the end of the air guide 300 to the cooling fan 114.

With reference again to the assembled embodiments illustrated in FIGS. 4 and 6, the air guide 300 can be configured such that the upper wall 302 is separated from the chassis floor 124 by a predetermined clearance C1, thereby minimizing or avoiding a transmission of noise or vibrations from the air guide 300 to the chassis floor 124 or other components of the appliance. For example, the upper wall 302 can be spaced from the lower surface of the chassis floor 124 by a sufficient amount such that the upper wall 302 is not capable of coming into physical contact with the lower surface of the chassis floor 124 during operation of the appliance 100. Similarly, as shown in another exemplary embodiment illustrated in FIG. 8, the air guide 300 can be configured such that one or both of the plate portions 308, 310 are separated from the chassis sidewall 126 or any other components by a predetermined clearance C2, thereby minimizing or avoiding a transmission of noise or vibrations from the air guide 300 to the chassis sidewall 126 or other components of the appliance.

As explained with reference to FIGS. 2 and 3, a cooling fan 114 may draw air A1 from the space between the cooktop floor 109 and the chassis floor 124 through one or more openings, perforations, cut-outs, knock-outs, etc. 401 in the chassis floor 124, chassis sidewall 126, or another component, and/or through gaps between parts of the chassis floor 124, chassis sidewall 126, or other components. The present invention recognizes that, as schematically illustrated by the dashed air-flow lines in FIG. 2, the air A1 may be more susceptible to being drawn toward or into the cooling fan 114 at areas at a closer distance to the cooling fan 114 than at areas at a greater distance from the cooling fan 114. As exemplarily illustrated in FIGS. 3 and 4, the air guide 300 can be configured such that the inlet 314 of the air guide 300 is disposed closer to the front of the housing 102 than a primary air A1 intake of at least one gas burner 108 of the cooktop, thereby avoiding disruption of the available primary air A1 for the at least one gas burner 108. For example, the air guide 300 can be configured such that the inlet 314 of the air guide 300 is disposed closer to the front of the housing 102 than a primary air A1 intake of a gas burner 108 located closest to the cooling fan 114, thereby avoiding disruption of the available primary air A1 for this gas burner 108. As shown in another exemplary embodiment illustrated in FIG. 9, the inlet 314 of the air guide 300 can be disposed closer to the front of the housing 102 than the primary air intakes of all of the gas burners 108, thereby avoiding disruption of the available primary air A1 to all of the gas burners 108. In these examples, the air guide 300 can provide a designated air duct in a simple manner that is capable of controlling, or at least constraining or limiting, a flow of the air A2 being drawn toward the cooling fan 114 such that the cooling fan 114 only draws the air A2 from areas of the housing 102 at, near, or adjacent to the front frame of the housing 102 and door 104 of the housing, and not through the chassis floor 124 from the space between the cooktop floor 109 and the chassis floor 124.

With reference again to FIGS. 3-9, an exemplary embodiment of the invention includes a home cooking appliance (e.g., 100) comprising a housing (e.g., 102), a cooktop (e.g., 106, 108) on the housing (e.g., 102), the cooktop having at least one gas burner (e.g., 108), a cooking compartment (e.g., 110) in the housing (e.g., 102) and accessible through a door (e.g., 104) in a front of the housing (e.g., 102), a cooling air system having a cooling fan (e.g., 114) that conveys cooling air (e.g., A2) through the housing (e.g., 102), and an air guide (e.g., 300) between the cooktop (e.g., 106, 108) and the cooking compartment (e.g., 110), the air guide (e.g., 300) including an inlet (e.g., 314) located away from a space below the at least one gas burner (e.g., 108) of the cooktop and an outlet (e.g., 316) in fluid communication with the cooling fan (e.g., 114), the air guide (e.g., 300) configured to restrict air (e.g., A1) from being drawn into the cooling fan (e.g., 114) from the space below the at least one gas burner (e.g., 108) of the cooktop. In this way, the present invention provides a home cooking appliance having an air guide capable of restricting (e.g., preventing or minimizing) air from the space between the cooktop and the chassis floor from being drawn into the fan, thereby avoiding disruption of available air in the space between the cooktop and the chassis floor that is available for use as primary air by the burners, stabilizing burner flames (e.g., color, shape, heat output, etc. of the flame kernels), and increasing overall burner performance.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A home cooking appliance comprising:

a housing;

a cooktop on the housing, the cooktop having a cooktop floor supporting at least one gas burner and a cooktop chassis below the cooktop floor, the cooktop floor and the cooktop chassis defining a space therebetween and below the at least one gas burner, the cooktop chassis having one or more openings;

a cooking compartment in the housing and accessible through a door in a front of the housing;

a cooling air system having a cooling fan that conveys cooling air through the housing; and an air guide between the cooktop chassis and the cooking compartment, the air guide including a top wall defining an inlet located away from the space below the at least one gas burner of the cooktop and an outlet in fluid communication with the cooling fan and defining a flow path between the inlet and the outlet, the top wall of the air guide being disposed below the cooktop chassis and configured to restrict air from being drawn from the space above the cooktop chassis and below the at least one gas burner of the cooktop through the one or more openings in the cooktop chassis and into the cooling fan by isolating the flow path from the one or more openings in the cooktop chassis.

2. The home cooking appliance of claim 1, wherein the inlet is disposed closer to the front of the housing than a primary air intake of the at least one gas burner in the space below the at least one gas burner of the cooktop.

3. The home cooking appliance of claim 1, wherein the cooktop includes a plurality of gas burners, and wherein the inlet is disposed closer to the front of the housing than a primary air intake of each of the plurality of gas burners in the space below the plurality of gas burners of the cooktop.

4. The home cooking appliance of claim 1, further comprising:

a top insulation retainer above the cooking compartment, wherein the top wall of the air guide is disposed between the cooktop chassis and the top insulation retainer.

5. The home cooking appliance of claim 4, wherein the top wall of the air guide cooperates with the top insulation retainer to form the flow path between the inlet and the outlet.

6. The home cooking appliance of claim 4, wherein the air guide comprises at least three walls cooperating with the top insulation retainer to form the flow path between the inlet and the outlet.

7. The home cooking appliance of claim 6, wherein the three walls include the top wall and two sidewalls extending from the top wall, and wherein the two sidewalls contact the top insulation retainer to form a substantially sealed flow path between the inlet and the outlet.

8. The home cooking appliance of claim 7, wherein the two sidewalls include one or more flanges in contact with the top insulation retainer.

9. The home cooking appliance of claim 8, wherein the one or more flanges are coupled to the top insulation retainer.

10. The home cooking appliance of claim 7, wherein the top wall of the air guide is spaced from an underside of the cooktop chassis by a predetermined clearance.

11. The home cooking appliance of claim 1, wherein the top wall of the air guide is spaced from an underside of the cooktop chassis by a predetermined clearance.

12. The home cooking appliance of claim 1, wherein the air guide includes a flange extending from the top wall and coupled to the cooling fan.

13. The home cooking appliance of claim 12, wherein the cooling fan includes a lip configured to receive and secure the flange of the air guide to the cooling fan.

14. The home cooking appliance of claim 1, wherein the air guide includes a guide portion extending from the top wall at a top of the outlet and configured to guide air exiting the outlet to an intake of the cooling fan.

15. The home cooking appliance of claim 14, wherein the guide portion extending from the top wall at the top of the outlet includes a flange coupled to the cooling fan.

16. The home cooking appliance of claim 14, wherein the guide portion extending from the top wall at the top of the outlet includes one or more angled plate portions.

17. The home cooking appliance of claim 14, wherein the cooktop chassis further comprises:

a chassis floor and at least one chassis sidewall, the cooktop floor, the chassis floor, and the at least one chassis sidewall defining the space below the at least one gas burner of the cooktop, the chassis floor and the at least one chassis sidewall disposed between the cooktop floor and the cooking compartment, wherein the top wall of the air guide is disposed between the chassis floor and the cooking compartment and the guide portion extending from the top wall at the top of the outlet is disposed between the at least one chassis sidewall and the cooling fan.

18. The home cooking appliance of claim 17, wherein the guide portion extending from the top wall at the top of the outlet of the air guide is separated from the at least one chassis sidewall by a predetermined clearance.

19. A home cooking appliance comprising:

a housing;

a cooktop on the housing, the cooktop including:

a cooktop surface supporting at least one bottom-breathing gas burner, and a cooktop chassis below the cooktop surface and the at least one bottom-breathing gas burner, the cooktop surface and the cooktop chassis defining a space therebetween and below the at least one bottom-breathing gas burner, the cooktop chassis having one or more penetrations, wherein the at least one bottom-breathing gas burner has a primary air intake in the space between the cooktop surface and the cooktop chassis;

a cooking compartment in the housing and accessible through a door in a front of the housing;

a cooling air system having a cooling fan that conveys cooling air through the housing; and an air guide below the cooktop chassis and above the cooking compartment, the air guide including a top wall defining an inlet located away from the space below the at least one bottom-breathing gas burner of the cooktop and an outlet in fluid communication with the cooling fan and defining a flow path between the inlet and the outlet, the top wall of the air guide configured to restrict air from being drawn from the space between the cooktop surface and the cooktop chassis having the primary air intake of the at least one bottom-breathing gas burner through the one or more penetrations in the cooktop chassis and into the cooling fan by isolating the flow path from the one or more penetrations in the cooktop chassis.

20. The home cooking appliance of claim 19, wherein the top wall of the air guide is spaced from an underside of the cooktop chassis by a predetermined clearance.

* * * * *